US005649726A

United States Patent [19]

Rogers, Jr. et al.

[11] Patent Number: 5,649,726

[45] Date of Patent: Jul. 22, 1997

[54] VEHICLE CLOSURE LATCH

[75] Inventors: Lloyd Walker Rogers, Jr., Utica; Eluid David Carter, Detroit; Joseph Michael Johnson, Huntington Woods; Michael Antonio Ciavaglia, Dearborn, all of Mich.

[73] Assignee: General Motors Corporation, Detroit, Mich.

[21] Appl. No.: 652,016

[22] Filed: May 21, 1996

[51] Int. Cl.[6] ..... E05C 3/06

[52] U.S. Cl. ..... 292/201; 292/216; 292/DIG. 23

[58] Field of Search ..... 292/201, 216, 292/DIG. 23, DIG. 27

[56] References Cited

U.S. PATENT DOCUMENTS

| | | | |
|---|---|---|---|
| 4,364,249 | 12/1982 | Kleefeldt | 292/DIG. 23 X |
| 4,518,181 | 5/1985 | Yamada | 292/201 |
| 4,520,914 | 6/1985 | Kagiyama et al. | 292/DIG. 23 X |
| 4,727,301 | 2/1988 | Fulks et al. | 318/468 |
| 4,756,563 | 7/1988 | Garwood et al. | 292/216 |
| 4,763,936 | 8/1988 | Rogakos et al. | 292/201 |
| 5,066,054 | 11/1991 | Ingenhoven | 292/216 X |
| 5,078,436 | 1/1992 | Kleefeldt et al. | 292/216 X |
| 5,261,711 | 11/1993 | Mizuki et al. | 292/201 |
| 5,308,128 | 5/1994 | Portelli et al. | 292/216 |
| 5,348,357 | 9/1994 | Konchan et al. | 292/216 |
| 5,419,597 | 5/1995 | Brackmann et al. | 292/216 X |

FOREIGN PATENT DOCUMENTS

| | | | |
|---|---|---|---|
| 84181 | 4/1991 | Japan | 292/DIG. 23 |
| 2262769 | 6/1993 | United Kingdom | 292/201 |

*Primary Examiner*—Rodney M. Lindsey
*Attorney, Agent, or Firm*—Ernest E. Helms

[57] ABSTRACT

A vehicle closure latch is provided which includes an actuator with a first wheel selectively reversibly powered to rotate along a first axis; a second wheel coaxial with the first wheel, the second wheel having a first face directed toward the first wheel; at least one arcuate slot formed on one of the wheels with a center of rotation generally co-terminus with the first axis, the slot having first and second ends spaced from one another and a pin connected on the other wheel that the arcuate slot is formed on, the pin being captured by the slot between the ends of the slot and being able to move therebetween; the second wheel further including a cam profile on a second face opposite the first face, the cam profile encapturing the stud of a manually operated locking lever, wherein rotation of the second wheel in a first circular direction will cause the manually operated locking lever to pivot moving the locking lever to the locking position and rotational movement of the second wheel in a second circular direction opposite the first circular direction will cause the manually operated locking to pivot moving the locking lever to the unlocked position, and wherein the manually operated locking lever can be moved between the locked and unlocked positions, without any substantial movement of the first wheel.

9 Claims, 9 Drawing Sheets

FIG-7
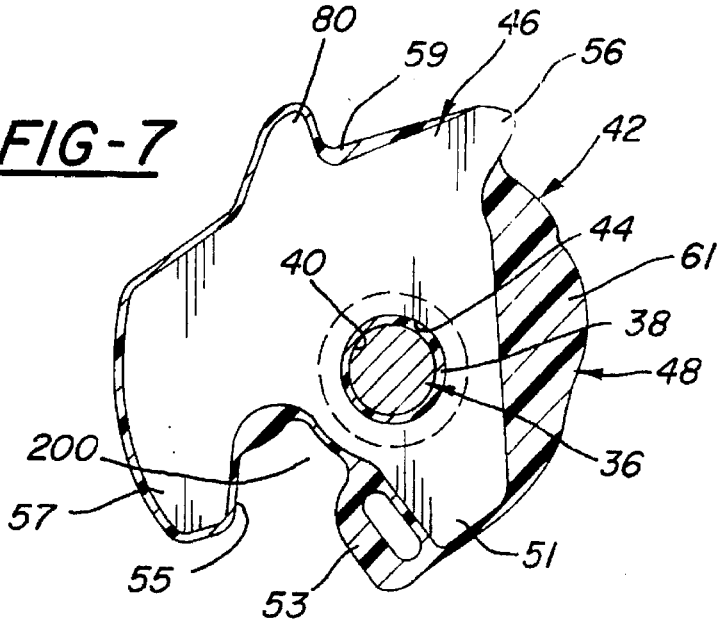
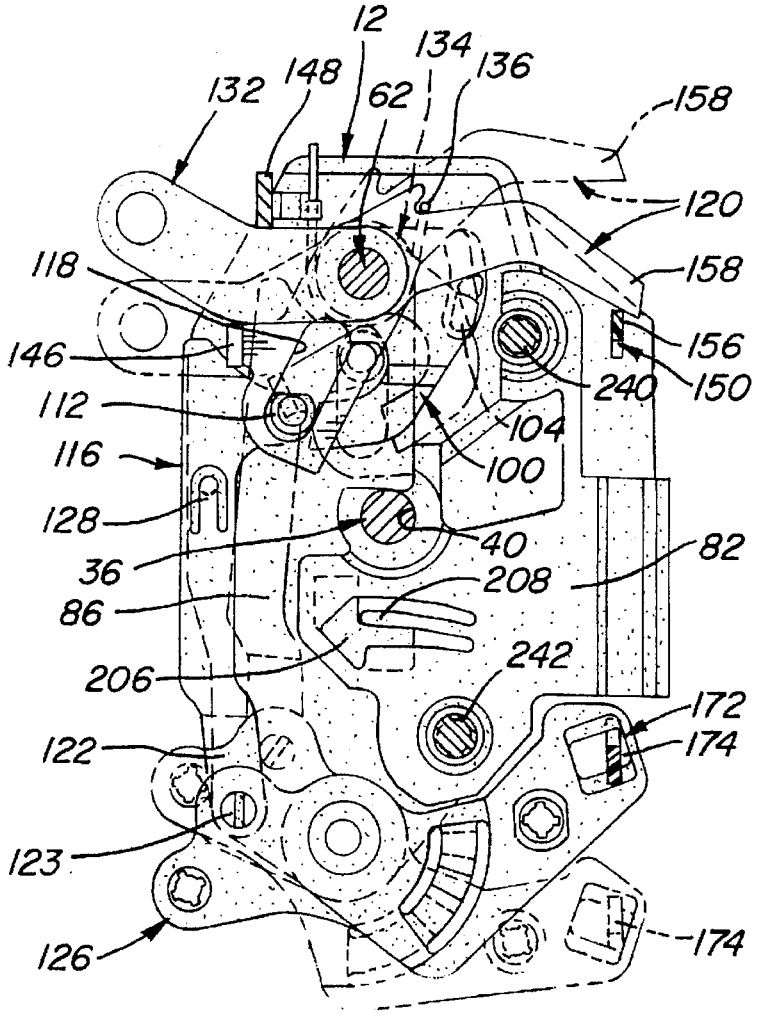
FIG-3

VEHICLE CLOSURE LATCH

BACKGROUND OF THE INVENTION

This invention relates to a vehicle closure latch and more particularly to a ratchet type vehicle closure latch with powered actuation.

Many vehicles are now provided with powered closure latches which are actuated by an electric motor. Since the closure latch is powered by a vehicle electrical system, there must be provided some type of mechanism to unlock the door from the interior of the vehicle if the electrical system fails. Therefore, vehicles have a manually operated locking lever which can be utilized to unlock a closure latch that was previously locked by a power actuator. It is highly desirable that the manually operated locking lever be as easy to operate as possible and require a very low force effort.

SUMMARY OF THE INVENTION

The present invention provides a power door closure latch with a manual "override" or locking lever with very low actuation force requirements.

In a preferred embodiment, the actuator of the present invention provides an electrically powered worm gear. The worm gear drives a gear wheel. The gear wheel, via a pin and slot lost motion arrangement, drives a cam wheel. The cam wheel has a profile, which when rotated, moves a manually operated locking lever between locked and unlocked positions. Due to the lost motion arrangement between the cam wheel and the gear wheel, the manual locking lever may be freely operated without any movement of the electric motor.

These and other features of the closure latch of this invention will be readily apparent to those skilled in the art as the nature of the invention is better understood from the accompanying drawings and detailed description.

BRIEF DESCRIPTION OF THE DRAWINGS

FIG. 3 is a rear view taken substantially along line 3—3 of FIG. 2. The latched and unlocked condition is shown in solid lines while various parts are also shown in phantom in unlatching or locked positions;

FIG. 7 is an enlarged front view of the insert molded closure latch ratchet;

DESCRIPTION OF THE PREFERRED EMBODIMENT

Figure 1:
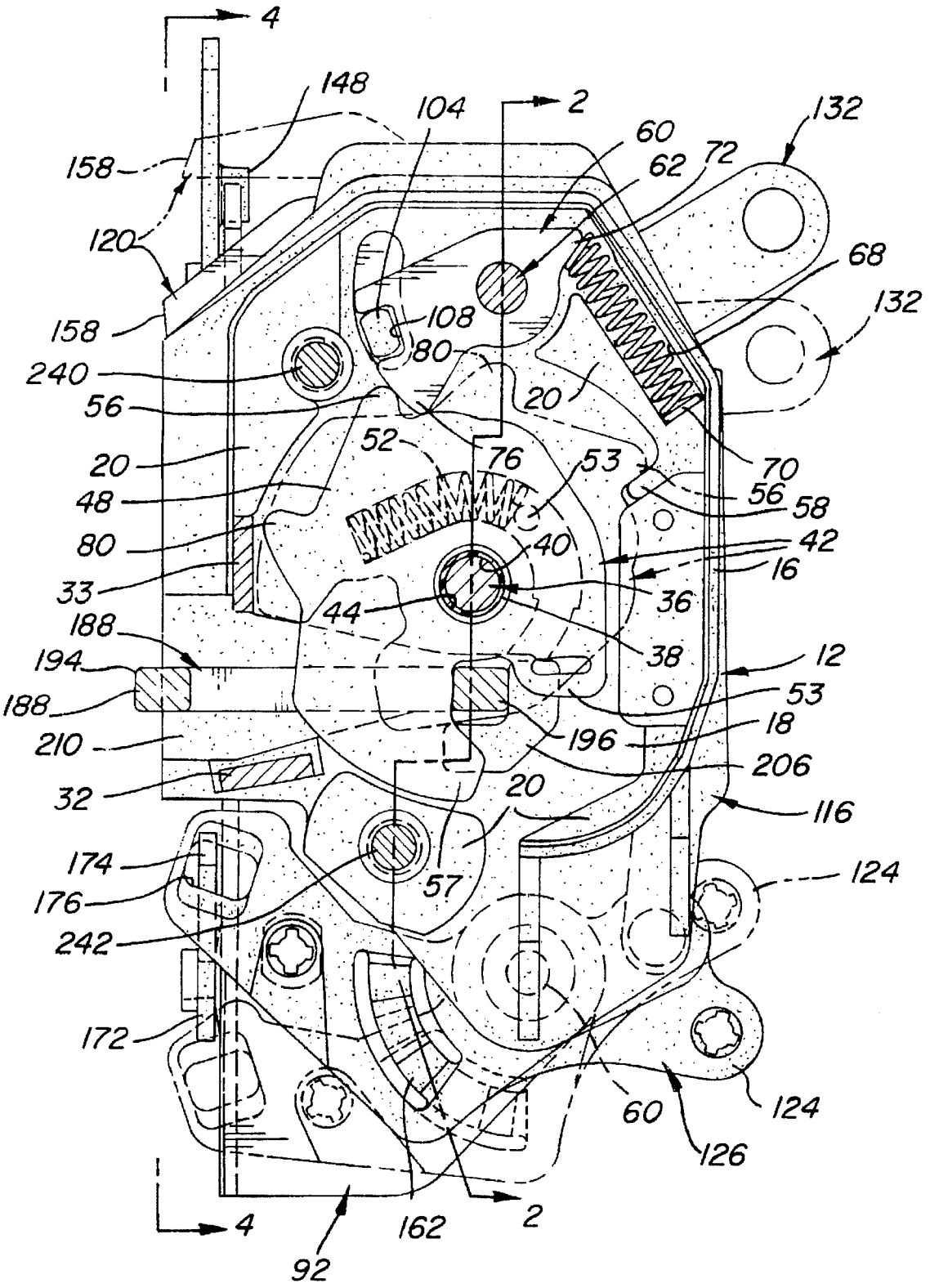
FIG. 1 is a partially broken away from view showing a manual vehicle closure latch in a latched and unlocked condition in solid lines. Various parts are also shown in phantom in unlatching or locked positions.
Figure 2:
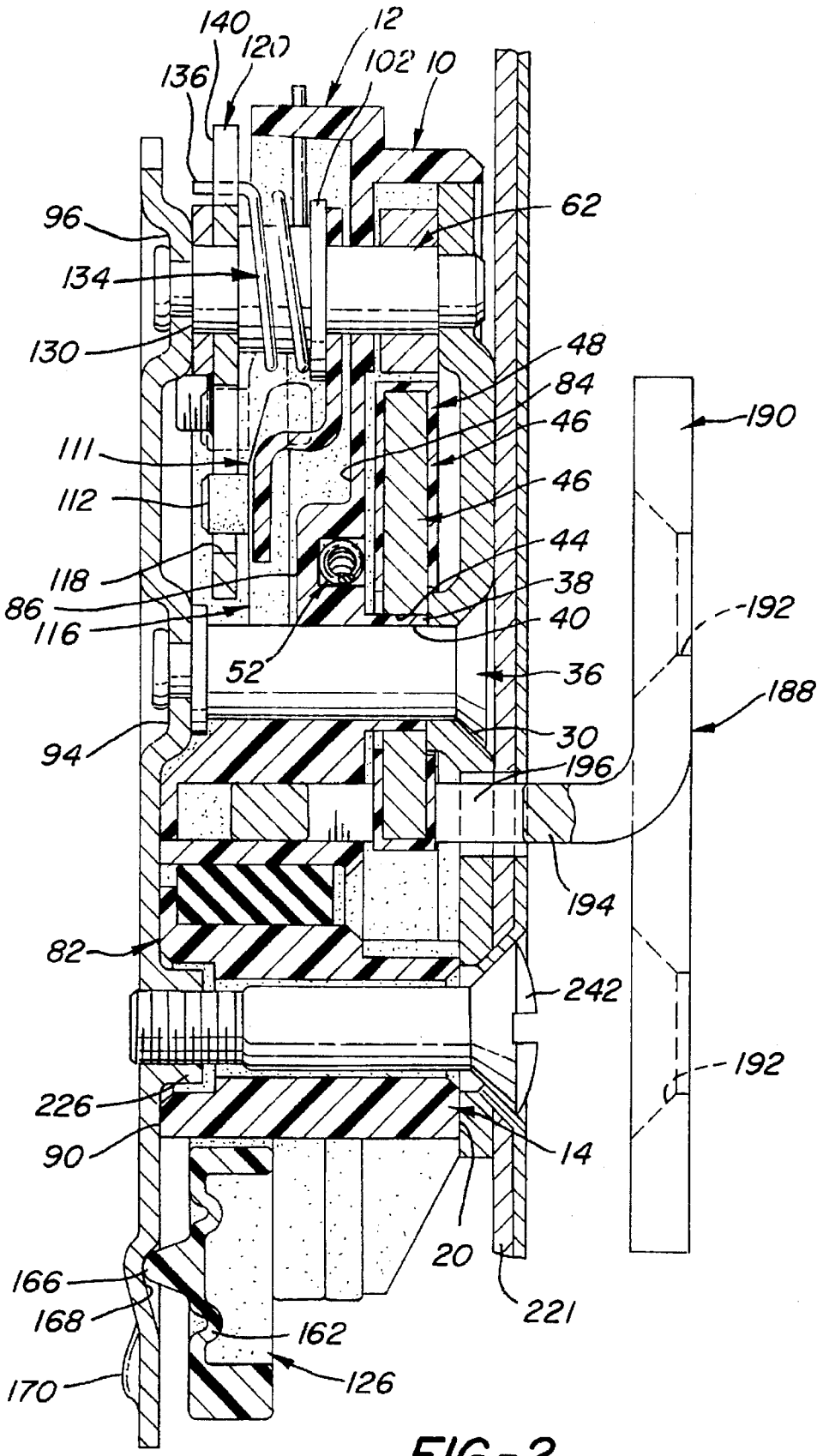
FIG. 2 is a sectional view taken substantially along line 2—2 of FIG. 1. An intermittent lever is also shown in phantom in a locked position.
Figure 6:
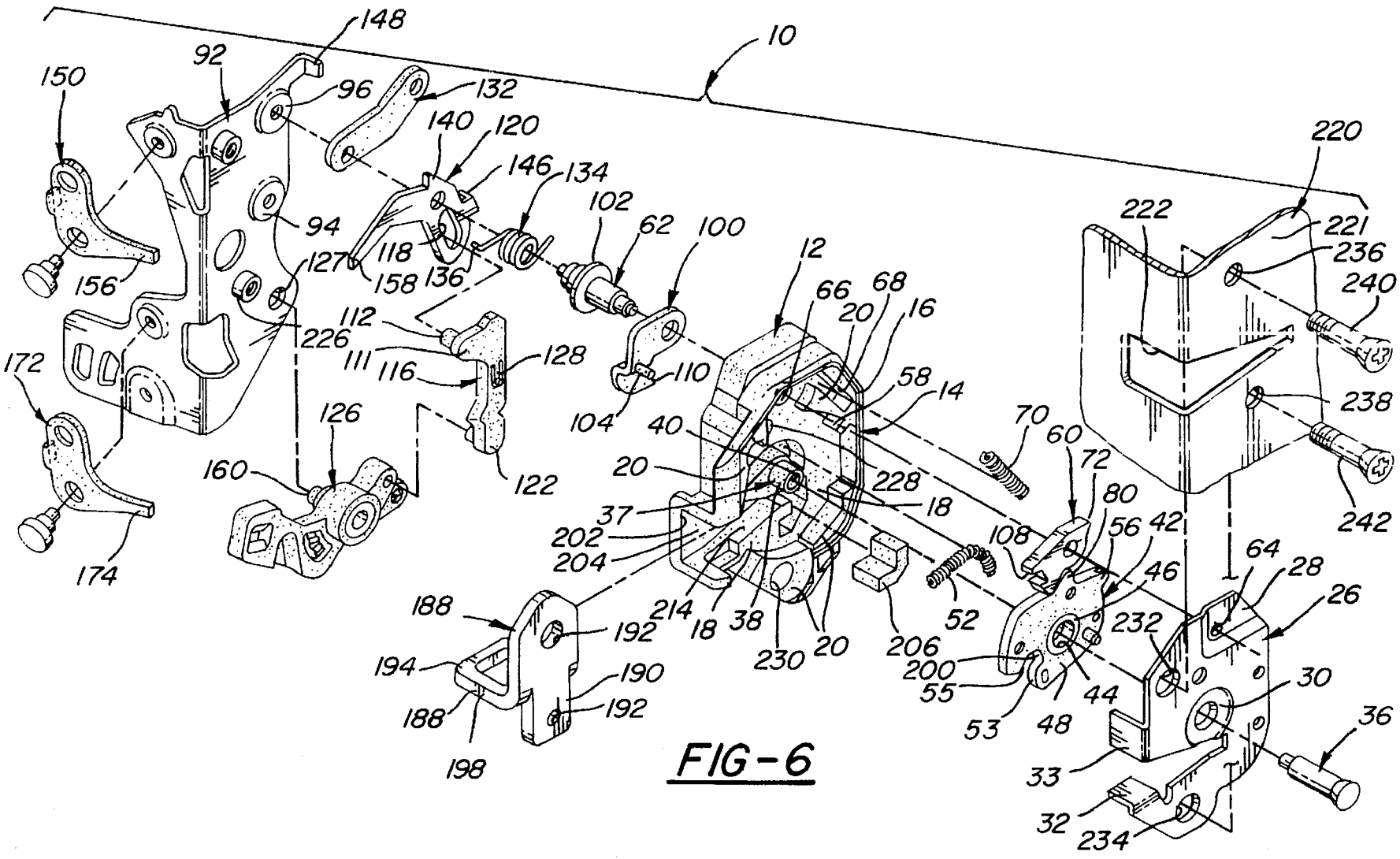
FIG. 6 is an exploded perspective view of the vehicle closure latch and a fragment of the door on which it is installed.

Referring to FIGS. 1, 2 and 6, a vehicle closure latch 10 includes a one-piece molded plastic housing member 12 which opens to a front side 14. The housing 12 includes relatively thin, broken peripheral wall 16, that outlines a cavity that has a recessed base wall 18. The housing 12 also has a number of coplanar shelf portions 20 inside the peripheral wall 16 that are only slightly recessed. A metal cover plate or frame member 26 fits within the wall portions 16, and seats on the shelf portions 20 to close the front side 14 of the housing 12. The frame 26 includes an inwardly recessed upper corner portion 28, an extruded central portion 30 and a pair of side tabs 32 and 33 as shown in FIG. 6.

A ratchet stud 36 is received by the extruded central portion 30 of the frame 26 which provides an increased support surface for the head end of the stud 36. A portion of the stud 36 is disposed in a thin plastic sleeve 37 that is integrally attached to the housing 12 and then in a hole 40 through the base wall 18 as shown in FIG. 2. The thin plastic sleeve facilitates assembly and then breaks away in service to provide a sleeve bearing 38 between the stud 36 and a rotatable closure latch ratchet 42.

Referring now to FIGS. 1, 6 and 7, the ratchet 42 comprises a metal substrate 46 that has a hole 44 that receives the stud 36 and the sleeve bearing 38 so that the ratchet 42 rotates on the stud 36 without any metal-to-metal contact. The integral plastic sleeve 37 then has two primary functions, that of locating the ratchet 42 during assembly, and that of providing a sleeve bearing 38 that eliminates metal-to-metal contact between the ratchet 42 and the stud 36 when the ratchet 42 rotates in service.

The metal substrate 46 which is best shown in hidden line in FIG. 7, is injection molded in a covering 48 of relatively tough and stiff thermoplastic material such as Santoprene, a product of Monsanto Company of St. Louis, Mo. The plastic covering 48 does not cover the hole 44 or the faces of the substrate 46 near the hole 44 of the ratchet 42, as best seen in FIGS. 5, 6 and 7 to avoid interfering with rotation of the ratchet 42.

Figure 5:
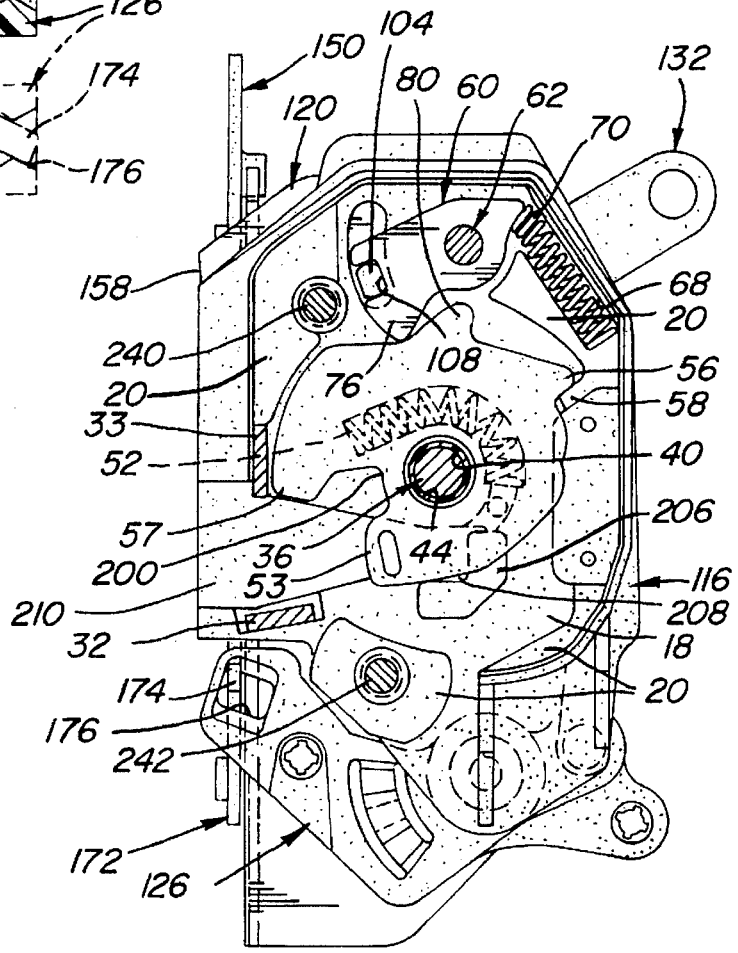
FIG. 5 is a view similar to FIG. 1 showing the vehicle closure latch in an unlatched and unlocked condition.

The plastic covering 48 also does not cover the peripheral surface of a primary latching tooth 56 so that there is metal-to-metal contact between the primary latching tooth 56 and the pawl 60 when the ratchet 42 is in the latched position as shown in FIGS. 1 and 5. The plastic covering 48, however does has a substantial presence in other peripheral areas. The covering 48 includes a thick portion in front of a striker tooth 51 that is slotted to provide an integral bumper 53 for cushioning initial engagement of a striker when the vehicle door is closed as explained below. The plastic covering 48 also includes another cushion 55 covering a keeper portion 57 of the ratchet 42 that engages the striker when the ratchet is in the latched position as shown in FIGS. 1 and 5. The plastic covering 48 also includes yet another cushion 59 that covers the periphery of the substrate 46 between the keeper portion 57 and the peak of the primary latching tooth 56 for quiet operation as the pawl 60 ratchets over a secondary latching tooth 80 when the door is closed. The plastic covering 48 further includes a large chord shaped area 61 between the primary latching tooth 56 and the striker tooth 51 that reduces the size and weight of the metal substrate 46 and also provides a base for an integral pin 43.

Referring now to FIG. 2, a groove 50 in the recessed base wall 18 houses a coil compression spring 52. The pin 53, as seen in hidden line in FIG. 1, molded integral with the sound deadening plastic covering 48 of the ratchet 42, engages one end of the coil compression spring 52. The other end of the spring 52 engages an end wall of the groove 50, so that the spring 52 biases the ratchet 42 clockwise from a latched position shown in solid line in FIG. 1 through an intermediate latched position (not shown) to an unlatched position shown in phantom in FIG. 1 and in solid line in FIG. 5 when pawl 60 is disengaged. The primary latching tooth 56 engages a shoulder 58 of the housing 12 to stop the ratchet 42 in the unlatched position.

Referring now to FIGS. 2 and 6, a pawl 60 is pivotally mounted on a pawl stud 62 for movement between an engaged position shown in solid line in FIG. 5 and an unlatching position shown in phantom in FIG. 5. A groove 68 in one of shelf portions 20 of the housing 12 houses a second coil compression spring 70. A shoulder 72 of the pawl 60 engages one end of the coil compression spring 70. The other end of the spring 70 engages an end wall of the groove 68 biasing the pawl 60 counterclockwise, as viewed in FIGS. 1 and 5, toward the engaged position. The pawl 60 has a pawl tooth 76 which engages the primary latching tooth 56 of the ratchet 42 as shown in FIG. 1 to latch the ratchet 42 in the fully latched position. Although not shown in the drawings, the pawl tooth 76 is also engageable with the secondary latching tooth 80 of the ratchet 42 to locate the ratchet 42 in an intermediate latched position where the ratchet 42 retains the striker 188 loosely.

Referring to FIGS. 2 and 3, the housing 12 has a back side 82 with a series of rear base wall portions 84, 86, and 90, which are parallel. A metal back plate 92 engages the outer rear base wall portion 90 and includes a plurality of recessed portions 94 and 96 as shown in FIG. 6.

Referring to FIGS. 2 and 6, a non-metallic or plastic pawl release lever 100 is coaxially pivoted with the pawl lever 60 on the pawl stud 62 and between the rear base wall portion 84 and a rib 102 of the pawl stud 62. Referring to FIG. 1, the pawl release lever 100 has a lateral tab 104 which extends through a slot 106 in the housing 12 and is received by a notch 108 of the pawl 60 to couple the pawl release lever 100 to the pawl 60. Referring to FIGS. 3 and 6, an offset foot 110 of the pawl release lever 100 is engageable by an integral ear 111 of a non-metallic or plastic molded intermittent lever 116.

Referring to FIGS. 2 and 3, the integral ear 111 of the intermittent lever 116 has a pin 112 that is slideably captured in a linear tracking slot 118 of an unlatching lever 120. A lower end 122 of the intermittent lever 116 is pivotably mounted to a first end 124 of a locking lever 126 by a bifurcated protrusion 123 of the intermittent lever 116 that is biasingly engaged in a hole in the locking lever 126 to provide for quiet anti-rattle rotation. As shown in FIGS. 3 and 6, the intermittent lever 116 is interposed between the locking lever 126 and unlatching lever 120 on one side, and the rear base wall portion 86 of the housing 12 on the other. An integrally molded finger 128 of the intermittent lever 116 engages the rear base wall portion 86 to snugly bias the intermittent lever 116 against the locking lever 126 and the unlatching lever 120 to prevent rattling. The intermittent lever 116 moves with the locking lever 126 between an unlocked position shown in solid line in FIGS. 2 and 3 and a locked position shown in phantom.

The rotation of the pawl release lever 100 is dependent on the position of the intermittent lever 116, which is part of the locking mechanism, and the rotation of the unlatching lever 120, which is part of the unlatching mechanism. The unlatching mechanism will be discussed more fully before the discussion of the locking mechanism.

Referring to FIGS. 2 and 6, the unlatching lever 120, whose slot 118 receives the integral pin 112 of the intermittent lever 116, is pivotably mounted on the pawl stud 62 between a shoulder 130 of the pawl stud 62 and a non-metallic plastic molded outside operating lever 132. A coil torsion spring 134 encircles the panel stud 62 between the rib 102 and the shoulder 130, and it has a leg 136 which engages an upper edge 140 of the unlatching lever 120, as seen in FIG. 3. The other end of the coil torsion spring 134 engages a ramp on the housing 12 so that the torsion spring 134 biases the unlatching lever 120 clockwise to a rest position seen in FIG. 3. It should be noted that FIGS. 1, 5 and 6 are front views while FIG. 3 is a rear view. Consequently spring 134 biases unlatching lever 120 counterclockwise in FIGS. 1, 5 and 6.

Referring to FIGS. 3 and 6, the outside operating lever 132, pivotably mounted on the pawl stud 62 and interposed between the back plate member 92 and the unlatching lever 120, seats on a lateral tab 146 of the unlatching lever 120. Referring to FIG. 3, an outside door handle (not shown) rotates the outside operating lever 132 counterclockwise to unlatch the closure latch 10. The outside operating lever 132 rotates the unlatching lever 120 counterclockwise simultaneously from their rest positions to their respective unlatching position, shown in phantom in FIG. 3. When released the outside operating lever 132 is returned to its rest position by the lateral tab 146 of the unlatching lever 120 transferring the bias of the torsion spring 134. A lateral tab 148, best seen in FIGS. 3 and 6, of the back plate 92 limits the clockwise motion of the outside operating lever 132 and the unlatching lever 120.

Figure 4:
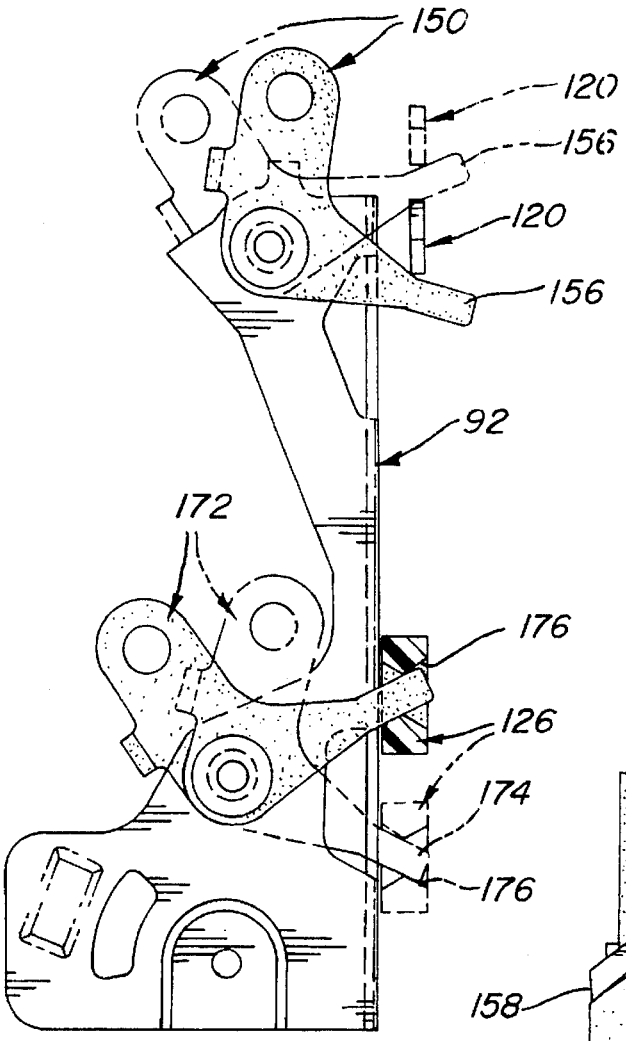
FIG. 4 is a partial sectional view taken substantially along line 4—4 of FIG. 1 with various parts also shown in phantom in unlatching or locked positions.

Referring to FIGS. 3, 4 and 6, a non-metallic plastic molded inside operating lever 150 is also capable of rotating the unlatching lever 120 to an unlatching position against the bias of torsion spring 134. The inside operating lever 150 is pivoted at 152 to a side flange 154 of the back plate 92 and it has a leg 156 underlying a leg 158 of the unlatching lever 120. The inside operating lever 150 is connected to and rotated by an inside operating handle, not shown. When lever 150 is rotated clockwise as viewed in FIGS. 4 and 6, it rotates the unlatching lever 120 counter clockwise is viewed in FIG. 3 (clockwise as viewed in FIG. 6).

Now that the operating levers of the unlocking mechanism have been described fully, the description of the locking mechanism will be completed. Referring to FIGS. 1 and 2, the locking lever 126 is pivotably mounted at 160 between a portion of the housing 12 and the back plate 92 by an integral protrusion of the housing 12 that fits in a pivot hole in the locking lever 126 and a stud of the locking lever 126 that fits in a pivot hole 127 in the back plate 92. The locking lever 126 includes an integral deflectable web 162 having a shoulder 166 biased into engagement with either a first recess 168 or a second recess 170 of the back plate 92 is shown in FIG. 2 to locate the locking lever 126 in either the unlocked position shown in solid line in FIG. 1 or in the locked position shown in phantom. The deflectable web 162 also provides tactile feel of the locking mechanism establishing positive position of the locking lever 126 in either the locked or unlocked position. The web 162 is made deflectable by spaced U-shaped portions connecting the shoulder 166 to the main part of the locking lever 126, as shown in FIG. 2.

The first end 124 of the locking lever 126 has an opening which is connected to an outside key cylinder by rod, or other suitable means, to move the locking lever 126 between the locked and unlocked positions.

Referring to FIGS. 1 and 4, a non-metallic, plastic molded inside locking lever 172 is pivotably mounted to the side flange 154 of the back plate member 92 at pivot point 173. The inside locking lever 172 is conventionally connected to an inside lock operator such as a linearly shiftable slide button. The inside locking lever 172 includes a leg 174 which is received within a tapered opening 176 at a second end 178 of the locking lever 126 such that movement of the inside locking lever 172 moves the locking lever 126 between its corresponding locked and unlocked positions. The inside locking lever 172 is identical to the inside operating lever 132 to reduce manufacturing cost.

With the unlatching mechanism and the locking mechanism described, the interaction between the two will be described. Referring to FIGS. 2 and 3, when the locking lever 126 and the intermittent lever 116 are in the unlocked position, thereby the integral pin 112 of the intermittent lever 116 is at a lower end 180 of the linear tracking slot 118 in the unlatching lever 120 in alignment for engagement with the foot 110 of the panel lever 100. Consequently, when the unlatching lever 120 is rotated counterclockwise by either the outside operating lever 132 or the inside operating lever 150 from the rest position to the unlatching position shown in phantom in FIG. 3, the integral pin 112 of the intermittent lever 116 engages the foot 110 of the pawl release lever 100 rotating the pawl release lever 100 and simultaneously rotate the pawl 60 to the unlatching position shown in phantom in FIG. 1. This disengages the pawl tooth 76 from the primary latching tooth 56 of the ratchet 42 which is then rotated clockwise by the spring 52 and/or the striker during door opening to the unlatched position shown in FIG. 5. Spring 70 returns the pawl 60 to the latched position when the unlatching lever 120 is released. During this unlatching movement, the intermittent lever 116 rotates about the bifurcated protrusion 123 which pivotally connects the lower end 122 to the locking lever 126.

When the locking lever and the intermittent lever 116 are in the locked position as shown in phantom in FIGS. 1 and 2 the integral pin 112 of the intermittent lever 116 is at an upper end 182 of the linear tracking slot 118 in the unlatching lever 120. Consequently when the unlatching lever 120 is rotated counterclockwise by either the outside operating lever 132 or the inside operating lever 150, the integral ear 111 of the intermittent lever 116 misses the foot 110 moving into a slot 184 of the pawl release lever 100 so that pawl release lever 100 and the pawl lever 60 are not rotated to the unlatching position and the pawl tooth 76 remains engaged with the primary latching tooth 56 of ratchet 42.

With the operating levers or unlatching mechanism and locking mechanism and their interaction described, the interaction of the door latch 10 with a striker 188 will be described. Referring to FIGS. 2 and 6, the striker 188 is formed out of a one-piece stamping which includes a mounting plate portion 190 having a pair of holes 192 for mounting to a vehicle body structure such as a vehicle pillar. Referring to FIG. 1, a loop striker portion 194 of rectangular cross section of the striker 188 includes an outboard leg 198 and an inboard leg 196. The outboard leg 198 is received in a throat 200 of the ratchet 42 of the door latch 10 when the door latch 10 is in the latched position.

Referring to FIGS. 1 and 6, the housing 12 of the door latch 10 has a deep recess 202 that extends inwardly from the base wall 18 to a back wall 204. The inner end of the recess 202 hooks back to form a spring arm 208 in cooperation with a slot through the back wall 204 as best shown in FIG. 3. A symmetrical elastomer bumper 206 is laterally inserted into the inner end of the recess 202 with the lower portion of the symmetrical elastomer bumper 206 being snapped past and held in place by the spring arm 208. The recess 202 defines a throat 210 within the plastic housing 12 to receive the striker 188. The frame 26 includes a "fishmouth" slot 212 that aligns with the throat 210 of the housing 12 when the frame 26 is attached. The side tabs 32 and 33 of the frame 26 project into slots of the housing 12 that communicate with the throat 210 as shown in FIGS. 1, 5 and 6. These tabs retain the ratchet 42 inside the plastic housing 12 in the event that the ratchet stud 36 and the plastic housing 12 itself do not do so.

Referring to FIG. 2, the door latch 10 is held together as an assembled door latch by the ratchet stud 36 and the pawl stud 62 which have their ends peened at the recessed portions 94 and 96 of the back plate 92 respectively. The ratchet stud 36 holds the plastic housing 12 metal frame 26 and back plate 92 together and also pivotally retains the ratchet 42 between the base wall 18 of the housing 12 and the metal frame 26. The pawl stud 62 peened at both ends helps align members 26, 12, and 92 and pivotally locates the pawl 60, the pawl release lever 100, the unlatching lever 120, and the outside operating lever 132 and carries the coil torsion spring 134. As stated above, the locking lever 126 is pivotably mounted at 160 and disposed between the housing 12 and the back plate 92. The inside operating lever 150 and the inside locking lever 172 are pivotally mounted on the side flange 154 of the back plate 92.

Referring to FIGS. 2 and 6, the assembled closure latch 10 is installed in a vehicle door 220 with the frame 26 abutting an interior surface of a free end wall 221 of a swinging door 220. The recessed corner portion 28 and the extruded central portion 30 of the metal frame 26 accommodate the head of the ratchet 36 and the peened head of the pawl 62 respectively. The end wall 221 and inner panel 223 of the door 220 have communicating slots that define an opening 222 that aligns with the throat 210 of the plastic housing 12 and the fishmouth slot 212 of the frame 26.

The closure latch 10 is attached to the door 220 by a pair of bolts 240 and 242 that are inserted into openings 236 and 238 in the end wall 221 through holes 232 and 234 in the frame 26 and holes 228 and 230 in the housing 12 and then screwed into threaded apertures 224 and 226 in the back plate 92. The bolts 240 and 242 also provide additional fasteners that hold the parts of the closure latch 10 together when the closure latch 10 is installed snug against the end wall 221.

Bolt 240 extends through the closure latch 10 in proximity to where the pawl tooth 76 of the pawl 60 engages one of the teeth 56 and 80 of ratchet 42 and sandwiches the engaged teeth between the housing 12 and the frame 26 so that the engaged teeth remain coplanar and do not bypass each other. In addition, the bolt 240, the ratchet stud 36 and the pawl stud 62 define an imaginary triangle that contains the engaged teeth of the ratchet 42 and pawl 60 between the housing 21 and the frame 36 providing further assurance that the engaged teeth do not bypass each other.

Bolt 242 extends through the door latch 10 in proximity to where the ratchet 42 engages the striker 188 when the ratchet 42 is in the latched position shown in FIG. 1. The ratchet stud 36 is about the same distance away on the opposite side of the throat 210 and the latched striker leg 196. The bolt 242 and the ratchet stud 36 both retain the closure latch 10 together and sandwich the ratchet 42 between the housing 12 and the frame 26 so that the ratchet 42 is held against lateral movement on both sides of the throat 210 near the engaged leg 196 of the striker 188. Consequently there is a very strong latching engagement of the striker 188.

The side tab 32 of the frame 26 protects the plastic housing 12 if the striker 188 is misaligned relative to the closure latch 10 and initially engages the throat 210 lower than desired. Moreover, as indicated earlier the side tabs 32 and 33 which are on opposite sites of the throat 210 are also positioned inboard of the ratchet 42 so that it cannot be pulled out of the plastic housing by the striker 188 as shown in FIG. 1 thereby enhancing the overall strength of the closure latch 10 under failure producing loads. It should also be noted the throat 210 of the plastic housing 12 and the fishmouth slot 212 of the cover plate 26 are relatively narrow when the vehicle closure latch 10 is designed for use with the striker 188 which is characterized by a loop portion of rectangular cross section. This relatively narrow fishmouth slot further enhances the overall strength of the door latch 10 because the minimum thickness of the metal plate 26 between the hole in the central portion 30 and the fishmouth slot 212 is increased in comparison to designs that are used with striker loop portions of circular cross section and that have the same operating effort.

The striker is the subject of U.S. Pat. No. 5,263,752 granted to MacPhail-Fausey et al. Nov. 23, 1993, and assigned to the assignee of this invention.

Basic Operation

Referring to FIGS. 1 and 5, as the door 220 is being closed, the outboard leg 196 of the striker 188 enters the throat 210 and engages the bumper 53 of the ratchet 42 and rotates the ratchet 42 counterclockwise from its unlatched position shown in FIG. 5, to its latched position shown in FIG. 1. The striker 188 is stopped in the latched position by the elastomer bumper 206. During this latching movement, the pawl tooth 76 first ratchets over the secondary latching tooth 80 and then the primary latching tooth 56 of the ratchet 42 until it engages the back side of the primary latching tooth 56 under the bias of compression spring 70.

This operation is quiet due to the sound deadening covering 48 of the ratchet 42 which is best shown in FIG. 7. First the striker engages the slotted bumper 53 which isolates the metal substrate 46 and deflects because of the slot to absorb the energy and sound of the striker 188 engaging the ratchet 42. Secondly the peripheral portion 59 of the covering 48 absorbs most of the energy and sound of the pawl 60 as the pawl tooth 76 ratchets on the ratchet 42 into position behind the primary latching tooth 56. Thirdly the latched leg 196 is stopped by the elastomer bumper 206 and held by the cushion 55 of the keeper portion 57 of the ratchet 42. This absorbs the energy and sound of the striker when the door is closed.

Referring to FIG. 2, the initial engagement and rotation of the ratchet 42 by the striker 188 creates a load on the thin plastic sleeve 37 that is generally uniform across the thickness of the ratchet 42. The thin plastic sleeve 37 that is integrally attached to the base wall 18 of the housing 12 in service without a radius which creates a stress riser at the corner of the sleeve and the base wall. The combination of the striker load and the stress riser causes the corner to fracture so that the thin plastic sleeve 37 breaks away from the base wall 18 of the housing 12 in service to provide a plastic sleeve beating 38 between the metal ratchet stud 36 and the metal bore of the ratchet 42 that functions as a silencer.

Unlatching the closure latch 10 to open the door is accomplished by releasing the striker 188 from the throat 200 of the ratchet 42 by disengaging the pawl tooth 76 from the primary latching tooth 56 so that the coil compression spring 52 returns the ratchet 42 to the unlatched position as described earlier. The door seal force also assists in latch disengagement of the striker 188.

The extensive use of non-metallic or plastic parts, except for the ratchet 42, the pawl 60 and the associated studs and springs which are required to hold the closure latch 10 in the latched position, the plastic covering of the ratchet 42 and the break-away sleeve beating 38 reduces the metal-on-metal contact to a minimum thereby creating a closure latch that is very quiet in operation and that requires little if any lubrication. Furthermore, the integral finger 128 of the intermittent lever 116 and the internal web 162 of the locking lever 126 reduce vibration of these parts and the associated noise to enhance quiet operation.

The latch shown in the Figures is a right-hand closure latch used on the passenger side of a vehicle. A left-hand closure latch for the driver side of the vehicle work the same, but the latches are mirrored images of each other. Consequently, some parts of the latch are designed so that they can be used for either a right-hand or left-hand closure latch to reduce manufacturing cost. For example, the pawl 60 and outside operating lever 132 are non-handed and can be used on either a right-hand or a left-hand closure latch by flipping the part over. The metal substrate of the ratchet 42 is also non-handed and capable of being used in either latch, prior to being insert molded, where the pin 53 is added to one side of the cover. The right angled elastomer bumper 206 is symmetrical about multiple planes so that the bumper 206 can be used one-way for a right hand latch or rotated 90 degrees for a left hand latch. In addition, the inside operating lever 150 and inside locking lever 172 are also identical to further reduce manufacturing costs.

Figure 8:
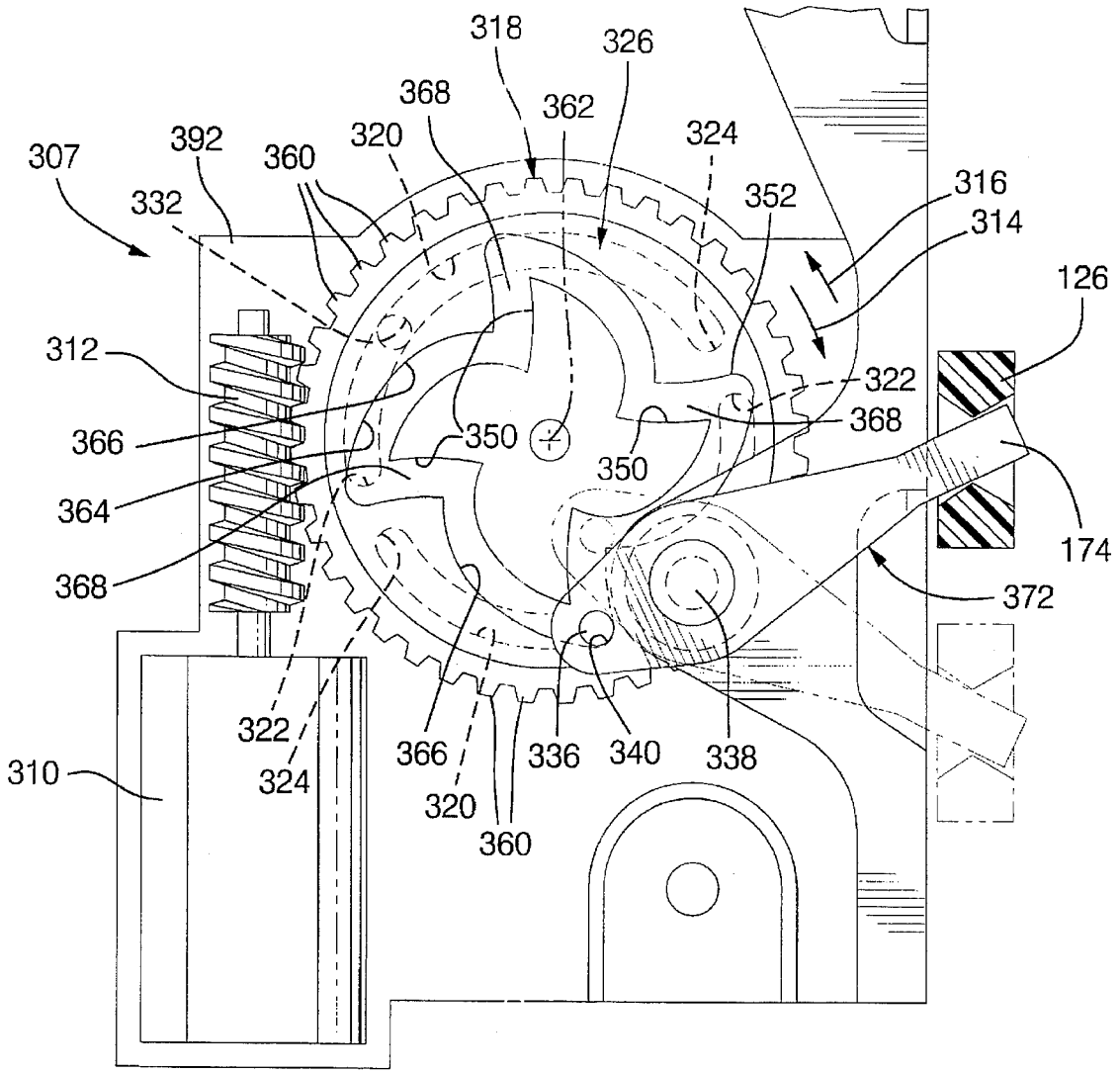
FIG. 8 is an enlarged sectional view of the inventive powered actuator for the closure latch of the present invention with the other portions of the closure latch being substantially identical to that previously shown and described in FIGS. 1 through 7.
Figure 9:
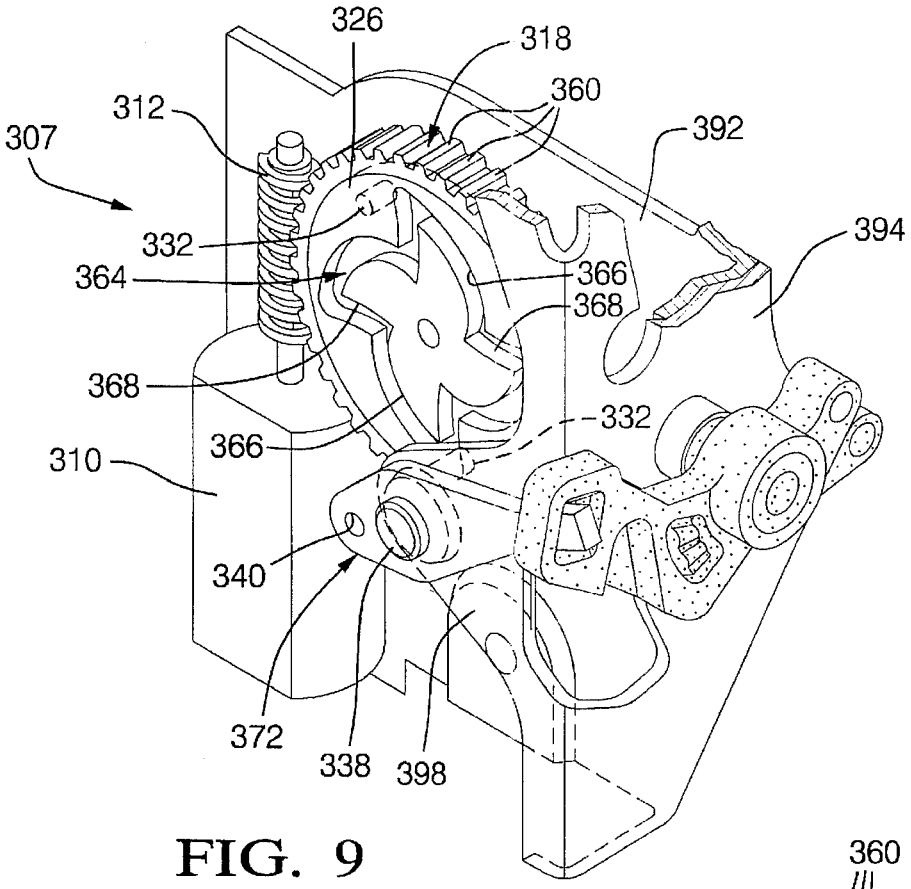
FIG. 9 is a perspective view of the actuator shown in FIG. 8.
Figure 10:
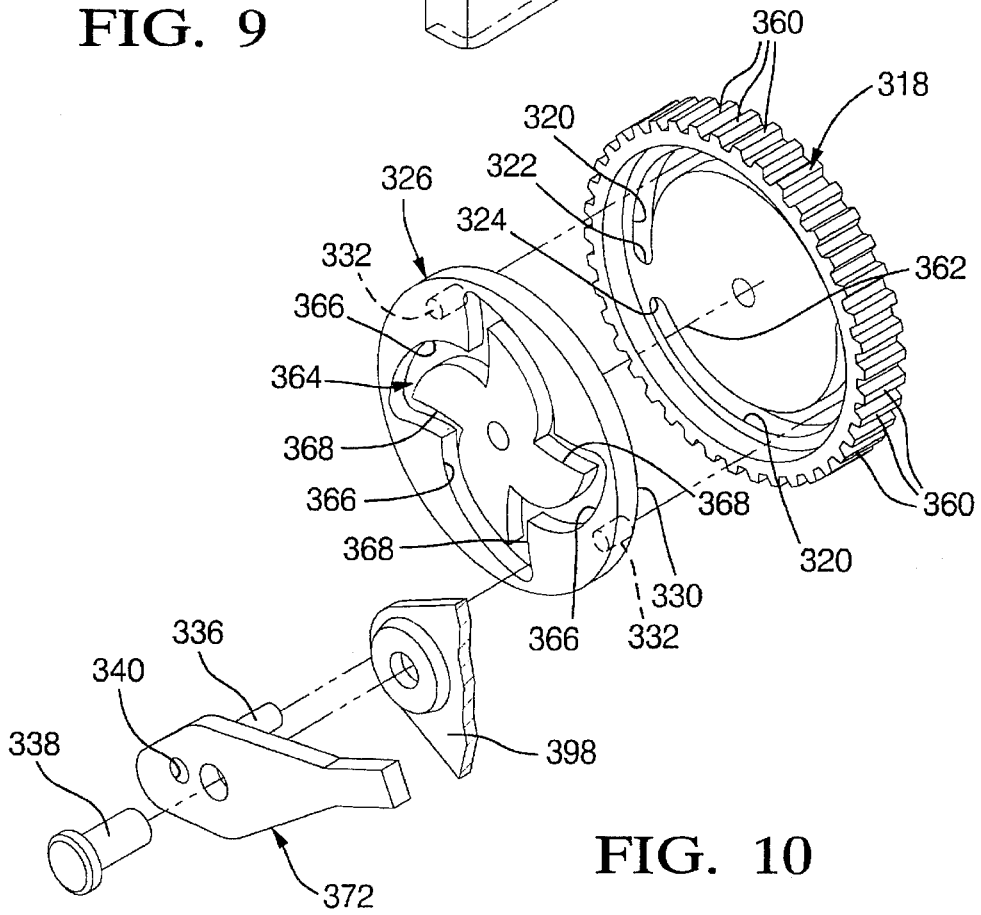
FIG. 10 is an exploded view of a gear wheel and cam wheel and the manually operated inside locking lever according to the present invention.

Referring additionally to FIGS. 8 through 10, the closure latch with the actuator 307 according to the present invention is powered by a reversible electric motor 310. The motor drives a worm gear 312 which meshes with a first or gear wheel 318 having gear teeth 360 along its outer surface. The gear wheel 318 has two opposed arcuate slots 320. The arcuate slots 320 have two extreme ends 324 and 322. The gear wheel 318 rotates about a first axis 362. The first axis is also co-terminus with the radial center of the arcuate slots 320. Fitted within a depression of the gear wheel 318 is a second or cam wheel 326. The cam wheel 326 has a rotational axis co-terminus the first axis 362.

On a first face 330 of the cam wheel facing toward the gear wheel, the cam wheel has two geometrically spaced pins 332. The pins are captured in the arcuate slots 320 of the gear wheel and are allowed to travel between the extreme ends of the arcuate slots 322 and 324.

On an opposite second face 328, the cam wheel 326 has a profile cam surface 364. The profile cam surface 364 includes a major curvilinear path 366 and a minor curvilinear path 368 which are geometrically repeated.

The profile cam surface 364 entraps a hollow stud 336. The stud 336 is connected with an end of an inside locking lever 372. The inside locking lever 372 performs a function similar to that of the inside locking lever 172 previously described and shown in FIGS. 6, 1 and 4 with some minor modifications.

In the example given in FIGS. 8 through 10, the stud 336 is made to be hollow to allow a connecting rod (not shown) to be inserted into a socket fitted within the aperture 340 provided on the inside locking lever 372. The rod (not shown) is operationally associated with an inside lock operator.

The closure latch 10 described in FIGS. 1 through 7, is further modified with a new backing plate 392. Backing plate 392 has an extension 394 fixably connected thereto. Extension 394 has a flanged portion 398 which allows pivotal mounting of the inside locking lever 372 via a pivot pin 338.

Figure 12:
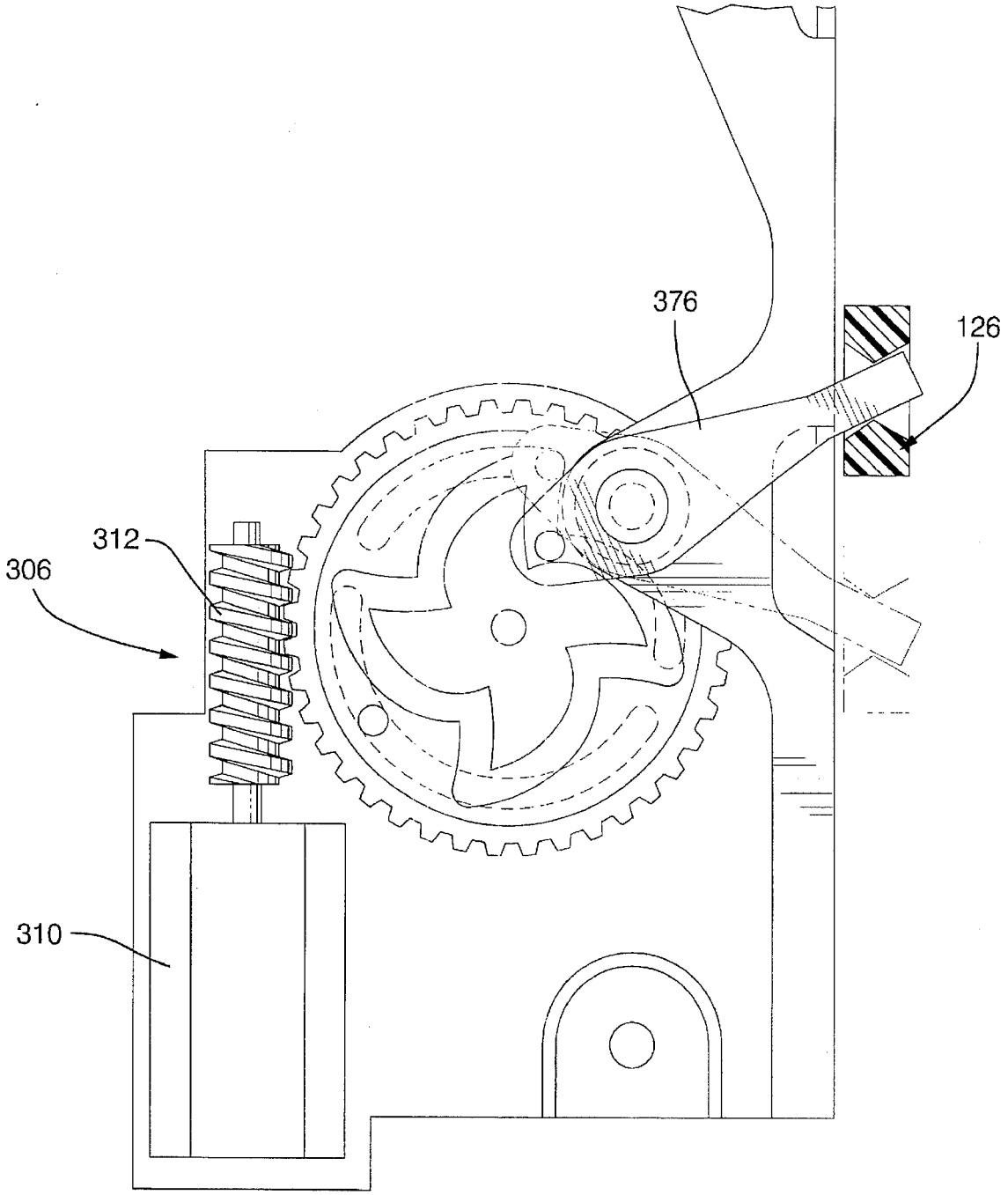
FIG. 12 is a view similar to that of FIG. 8 wherein in the locked position, a stud on the locking lever is radially further out than the position of the stud when the locking lever is in the unlocked position.

FIG. 8 is similar to FIG. 4 in that FIG. 8 illustrates the position of the locking lever 126 in solid line in the unlocked position and in phantom in the locked position. Additionally, the inside locking lever 372 is also shown in solid line in the unlocked position wherein the stud 336 is radially further away from the first axis 362 than when the locking lever is in the locked (or phantom) position. However, if so desired, the gear wheel 318 and cam wheel 326 can be displaced leftwardly as best shown in actuator 306 (FIG. 12) to allow the unlocked position (of the stud 336) to be further radially inward.

To move the locking lever to a locked position as shown in phantom in FIG. 8, the motor 310 will be energized to cause the gear wheel 318 to move in direction 316 (counterclockwise as shown in FIG. 8). The cam wheel 326 will remain stationary until the ends 324 of the arcuate slots 320 make contact with the pins 332. After the pins 332 are contacted, the cam wheel 326 will rotate counterclockwise forcing the stud 336 to move along the left hand upper quadrant major curvilinear path 366 causing the locking lever 372 to pivot about pivot pin 338 in a clockwise direction as shown in FIG. 8.

Upon completion of the cam wheel's 326 movement, the stud 336 will hit an almost perpendicular surface 350 stalling the motor 310. Thereafter, actuation is complete.

To move the inside locking lever 372 and the locking lever 126 from the locked position shown in phantom to the unlocked position shown in solid line, the first gear 318 will be rotated in a direction 314 (clockwise as shown in FIG. 8). The gear wheel 318 will not move until the ends 332 of the arcuate slots 320 contact the pins 332, therefore moving the cam wheel 326 in a clockwise direction.

Upon movement of the cam wheel 326 in a clockwise direction, the stud 336 will be forced to travel in the lower left hand quadrant major curvilinear path 366 until the stud hits a stall surface 352.

As will be obvious to that skilled in the art, in either the unlocked solid line or locked phantom position, the inside locking lever 372 can be freely pivoted between extreme positions in the minor curvilinear path 368.

The motor 310, if so desired, can be a non-back drivable motor. If the inside locking lever 372 is in the locked position (shown in phantom), as mentioned previously, to unlock the closure latch, the cam wheel 326 must be rotated in a clockwise direction until such time that the stud 336 stalls out on the stall surface 352. Therefore, a motor 310 failure may place the stud 336 at a midpoint of the major curvilinear path 336 at location 370. In such case of a failure, the closure latch can still be released by utilization of the inside locking lever 372 since the inside locking lever 372 can simply be rotated counterclockwise as shown in FIG. 8 causing the cam wheel 318 to rotate in direction 314 pulling the pin 332 away from the ends 322 in the arcuate slot. Therefore, the cam wheel 326 can be moved without movement of the gear wheel 318 due to the pin and slot arrangement between the gear wheel 318 and cam wheel 326.

An alternate scenario is effective to relock the closure latch when the motor 310 fails when moving the inside locking lever 372 from the locked (solid line) to the unlocked position since the pins 332 can be moved away from the ends 324 of the arcuate slots 320.

Figure 11:
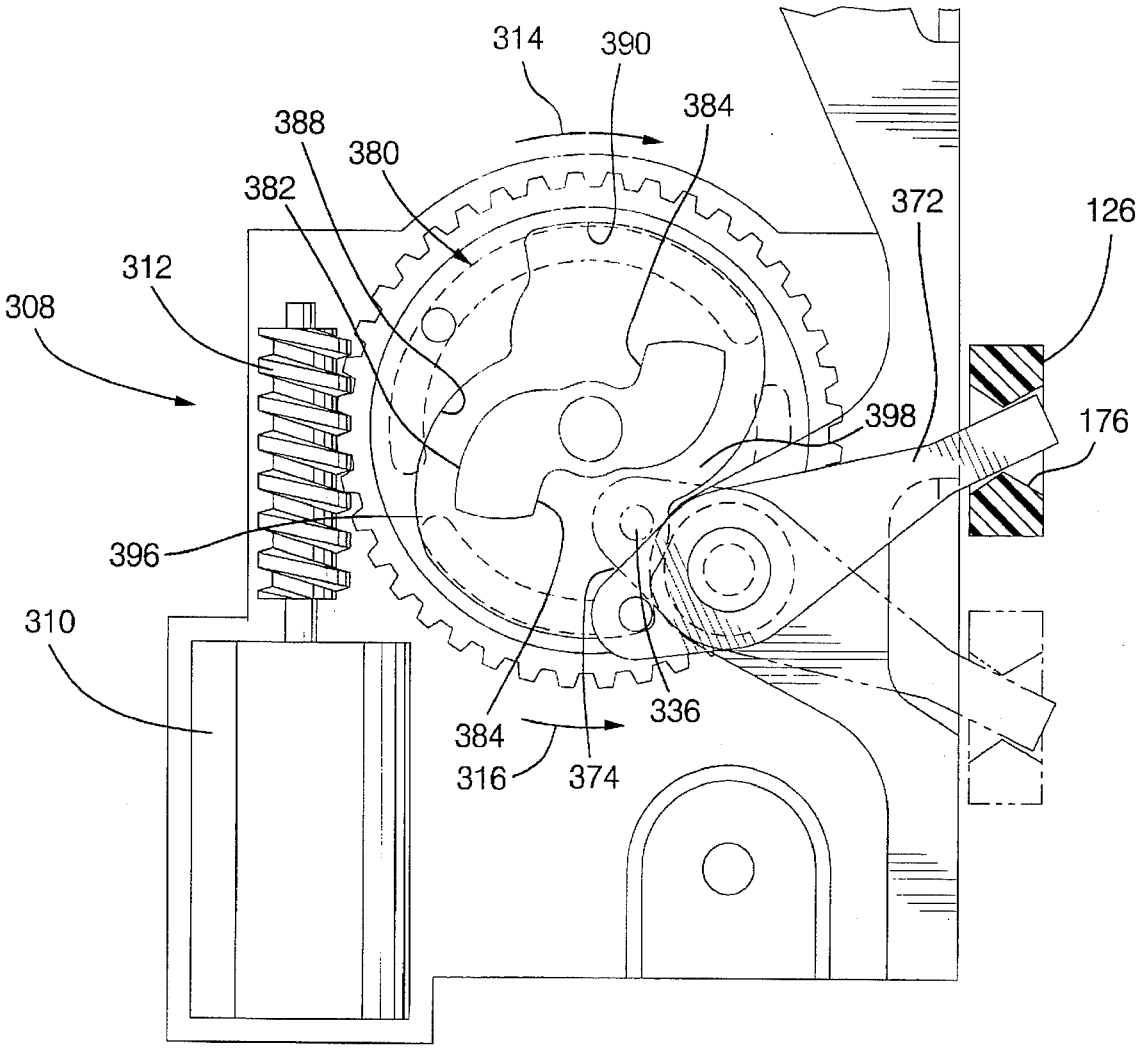
FIG. 11 is an alternative preferred embodiment of the cam wheel according to the present invention.

Referring additionally to FIG. 11, the present invention is provided with an actuator 308 with an alternate cam wheel 380. The cam wheel 380 has a cam profile central member 382 with radially inner stall surfaces 384. Cam wheel 380 also has radially outer surfaces 386. Using actuator 308 to go from the unlocked position to the locked position, the cam wheel 380 is rotated in direction 316 (counterclockwise as shown in FIG. 11) causing the stud 336 to be forced radially inward through path 388 until such time it hits the stall surface 384. To move from the unlocked to locked position, the cam wheel 380 will simply be rotated in the opposite direction.

As will be apparent to those skilled in the art, the total cam profile can be simplified by providing only one half of the central member 382, however, this will require the motor 310 to rotate the wheel gear 318 for a longer angular length to move the cam wheel 380 to the proper position.

Referring back to FIG. 8, if an individual improperly positions the inside locking lever 372 to place the inside locking lever midway through the minor curvilinear path 368 along location 378, the motor 310 will not be able to move until the inside locking lever 372 has been moved to one of its extreme (angular) positions.

Referring back to FIG. 11 (actuator 308), if the inside locking lever 372 is moved to place the stud 336 at position 374, the cam wheel 380 can still move clockwise or counterclockwise. After the cam wheel 380 has moved to the point to place the stud either at entrance 396 or entrance 398 of the curvilinear path 388, the actuator 308 will be resequenced and operation will continue as previously described. It should also be noted that the slot and pin arrangement between the cam wheel 380 and the gear wheel 318 is the same as that described between the cam wheel 336 and the gear wheel 318.

Referring lastly again to FIG. 12, an alternate preferred embodiment actuator 306 is shown wherein in the locked phantom position of the inside locking lever 372, the stud 336 is further out radially. This configuration has been found to be more favorable in some applications where a close reading of the output torque on the motor 310 is desired.

In another embodiment of the present invention, not shown, a cam wheel similar to that shown in FIG. 11 can be utilized wherein the stall surfaces 384 can be utilized to set a locked position rather than an unlocked position.

In the embodiment shown in FIGS. 8 through 12, no clutch or spring mechanism is required between the motor and the inside release lever. Therefore, the size of the motor 310 can be minimized since there is no energy loss due to compression of a spring. The cost of a complex clutch mechanism between the motor and the inside locking lever 372 is eliminated. However, the inside locking lever 372 can always work to move the locking lever 126 when an electrical power or motor failure has occurred.

The invention has been described in an illustrative manner, and it is to be understood that the terminology which has been used is intended to be in the nature of words of description rather than of limitation.

Obviously, many modifications and variations of the present invention in light of the above teachings may be made. it is, therefore, to be understood that, within the scope of the appended claims, the invention may be practiced otherwise than as specifically described.

What is claimed is:

1. A vehicle closure latch having latched and unlatched states, the closure latch having an unlatching lever for changing the closure latch to the unlatched state from the latched state, the closure latch further including a locking lever having an unlocked position relative to the unlatching lever to define an unlocked condition of the closure latch, and the locking lever having a locked position preventing the unlatching lever from establishing the unlatched state of the closure latch, the closure latch further including a manually operated locking lever for selectively moving the locking lever between the locked and unlocked positions, the manually operated locking lever having a stud connected thereto, and wherein the closure latch includes a powered actuator to move the locking lever between the locked and unlocked positions, the actuator including:

a first wheel selectively reversibly powered to rotate about a first axis;

a second wheel coaxial with the first wheel, the second wheel having a first face directed toward the first wheel;

at least one arcuate slot formed on one of the wheels with a center of rotation generally co-terminus with the first axis, the slot having first and second ends spaced from one another and a pin connected on the other wheel that the arcuate slot is formed on, the pin being captured by the slot between the ends of the slot and being able to move therebetween;

the second wheel further including a cam profile on a second face opposite the first face, the cam profile encapturing the stud of the manually operated locking lever, wherein rotation of the second wheel in a first circular direction will cause the manually operated locking lever to pivot moving the locking lever to the locking position and rotational movement of the second wheel in a second circular direction opposite the first circular direction will cause the manually operated locking lever to pivot moving the locking lever to the unlocked position, and wherein the manually operated locking lever can be operated to move the locking lever between the locked and unlocked positions, without any substantial movement of the first wheel.

2. A vehicle closure latch as described in claim 1, wherein the pin is connected to the first face of the second wheel.

3. A vehicle closure latch as described in claim 1, wherein there are two arcuate slots on one of the wheels and two pins connected on the other wheel, and each pin captured in one of the two arcuate slots.

4. A vehicle closure latch as described in claim 1, wherein the cam profile has a stall position to stall rotation of the first wheel when the closure latch is placed in the latched state by the actuator.

5. A vehicle closure latch as described in claim 1, wherein the cam profile has a position to stall the first wheel when the actuator is moving the locking lever to the unlocked position.

6. A vehicle closure latch as described in claim 1, wherein a common curvilinear path is defined by the cam profile and is used for moving the locking lever from the locked to the unlocked position and the unlocked position to the locked position, and wherein the cam profile can automatically sequence itself if the stud is positioned in an intermediate position in the cam profile.

7. A vehicle closure latch as described in claim 1 having a motor connected with a worm gear which is meshed with a geared surface of the first wheel.

8. A vehicle closure latch as described in claim 1 wherein the manually operated locking lever stud when the locking lever is in the locked position is radially closer to the first axis than when the locking lever is in the unlocked position.

9. A vehicle closure latch as described in claim 1, wherein the manually operated locking lever stud when the locking lever is in the unlocked position is radially further to the first axis than when the locking lever is in the locked position.

* * * * *